US011085693B2

(12) United States Patent
Fu et al.

(10) Patent No.: US 11,085,693 B2
(45) Date of Patent: Aug. 10, 2021

(54) METHOD FOR CONTROLLING OPERATION OF REFRIGERATOR THROUGH MECHANICAL ROTARY KNOB

(71) Applicant: QINGDAO HAIER JOINT STOCK CO., LTD., Qingdao (CN)

(72) Inventors: Dongxiao Fu, Qingdao (CN); Qinglin Liu, Qingdao (CN); Jilong Jia, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 199 days.

(21) Appl. No.: 16/473,234

(22) PCT Filed: Dec. 21, 2017

(86) PCT No.: PCT/CN2017/117606
§ 371 (c)(1),
(2) Date: Jun. 24, 2019

(87) PCT Pub. No.: WO2018/113713
PCT Pub. Date: Jun. 28, 2018

(65) Prior Publication Data

US 2020/0141633 A1 May 7, 2020

(30) Foreign Application Priority Data

Dec. 22, 2016 (CN) ..... 201611200714.2

(51) Int. Cl.
*F25D 29/00* (2006.01)
*F25D 3/04* (2006.01)

(52) U.S. Cl.
CPC ..... *F25D 29/003* (2013.01); *F25D 3/045* (2013.01); *F25D 29/005* (2013.01); *F25D 2600/04* (2013.01)

(58) Field of Classification Search
CPC ..... F25D 17/045; F25D 29/003; F25D 2323/0026
See application file for complete search history.

(56) References Cited

U.S. PATENT DOCUMENTS 3,630,046 A * 12/1971 Boor ..... F25D 17/045 62/408
3,759,053 A * 9/1973 Swaneck, Jr. ..... F25D 17/065 62/157

(Continued)

FOREIGN PATENT DOCUMENTS

CN 101975497 A 2/2011
CN 103884145 A 6/2014

(Continued)

*Primary Examiner* — Nelson J Nieves
(74) *Attorney, Agent, or Firm* — Cheng-Ju Chiang

(57) ABSTRACT

The present invention discloses an air volume adjustment device for a refrigerator. The air volume adjustment device comprises: a fan capable of introducing cold air from an evaporator into the first air inlet cavity and the second air inlet cavity; a baffle arranged between a first air inlet cavity of a first compartment and a second air inlet cavity of a second compartment, which is capable of moving among a plurality of positions to adjust the volume of air entering the first air inlet cavity and the second air inlet cavity; and an operating knob and a potentiometer which are connected to the front side and the rear side of the baffle, respectively. The operating knob is capable of operably driving the baffle to move. The potentiometer transfers an electrical signal corresponding to a position of the baffle to the controller for controlling the fan or the compressor.

10 Claims, 4 Drawing Sheets

(56) References Cited

U.S. PATENT DOCUMENTS 4,009,589 A * 3/1977 Webb ..... F25D 17/045 62/180
4,009,590 A * 3/1977 Webb ..... F25D 17/045 62/180
4,009,591 A * 3/1977 Hester ..... F25D 17/045 62/180
4,537,041 A * 8/1985 Denpou ..... F25B 5/00 62/199
4,614,092 A * 9/1986 Kim ..... F25D 17/045 251/251
4,663,941 A * 5/1987 Janke ..... G05D 23/24 62/156
4,682,474 A * 7/1987 Janke ..... F25D 17/045 236/46 F
4,688,393 A * 8/1987 Linstromberg ..... F25D 17/045 62/180
4,732,010 A * 3/1988 Linstromberg ..... F25D 17/045 62/155
4,920,765 A * 5/1990 McCauley ..... F25D 17/045 62/187
5,092,136 A * 3/1992 Kang ..... F25D 17/045 62/408
5,092,137 A * 3/1992 Elsom ..... F25D 17/045 62/408
5,097,675 A * 3/1992 Elsom ..... F25D 17/045 62/408
5,201,888 A * 4/1993 Beach, Jr. ..... F25D 17/045 251/129.13
5,458,186 A * 10/1995 Lee ..... F25D 17/065 165/263
6,044,659 A * 4/2000 Ji ..... F25D 17/045 62/408
6,094,932 A * 8/2000 Chiappetta ..... F25D 17/045 239/128
6,354,508 B1 * 3/2002 Fogh ..... G05D 23/19 236/78 R
6,434,954 B1 * 8/2002 Hess ..... F25D 17/045 62/407
6,644,051 B1 * 11/2003 Cho ..... F25D 17/045 62/186
6,763,677 B1 * 7/2004 Burchill ..... F24F 13/12 62/129
6,769,263 B1 * 8/2004 Armour ..... F16K 31/06 62/150
7,051,539 B2 * 5/2006 Junge ..... F25D 17/045 62/187
10,001,316 B2 * 6/2018 Simpson ..... F25D 17/045
2004/0244389 A1 * 12/2004 Denvir ..... F25D 21/002 62/156
2008/0307807 A1 * 12/2008 Graff ..... F25D 29/00 62/186
2016/0025388 A1 * 1/2016 Wait ..... F25B 21/04 62/3.3
2017/0227276 A1 * 8/2017 Pearson ..... F16K 31/042
2018/0216866 A1 * 8/2018 Xia ..... F16K 31/041
2020/0340739 A1 * 10/2020 Mardones Soto .... F25D 23/028

FOREIGN PATENT DOCUMENTS

CN 204141928 U 2/2015
CN 104956167 A 9/2015
CN 105222469 A 1/2016
CN 105758093 A 7/2016
CN 205641739 U 10/2016
CN 106679287 A 5/2017
CN 106679322 A 5/2017
EP 0686818 A2 * 12/1995 ..... F25D 29/00
FR 2599480 B1 4/1991
JP H1-127880 A 5/1989
JP H1-203876 A 8/1989
KR 10-2004-0049616 A 6/2004
WO WO-2004029527 A2 * 4/2004 ..... F25D 17/045
WO WO-2006072905 A1 * 7/2006 ..... F25D 17/045
WO 2011/081498 A2 7/2011
WO WO-2016070893 A1 * 5/2016 ..... F25D 17/045

* cited by examiner

METHOD FOR CONTROLLING OPERATION OF REFRIGERATOR THROUGH MECHANICAL ROTARY KNOB

The present application is a 35 U.S.C. § 371 National Phase conversion of International (PCT) Patent Application No. PCT/CN2017/117606, filed on Dec. 21, 2017, which claims priority to Chinese Patent Application No. 201611200714.2, filed on Dec. 22, 2016 and tiled "Method for Controlling Operation of Refrigerator through Mechanical Rotary Knob", which is incorporated herein by reference in its entirety. The PCT International Patent Application was filed and published in Chinese.

FIELD OF THE INVENTION

The present invention relates to the field of home appliances, and in particular, to a method for controlling the operation of a refrigerator through a mechanical rotary knob.

BACKGROUND OF THE INVENTION

In the prior art, refrigerators generally refer to single-door refrigerators, double-door dual-temperature refrigerators, three-door and three-temperature refrigerators, cabinet type multi-door refrigerators and the like, and generally provided with independent outer doors of freezing compartments and refrigerating compartments, so as to realize separate storage according to different storage temperatures. The refrigeration principles of these refrigerator-freezers are divided into a direct-cooled type and an air-cooled type. The direct-cooled refrigeration system generally uses a solenoid valve to control the flow direction of a refrigerant and supplies the refrigerant to an evaporator of the respective refrigerating (freezing) compartment, such that each space is cooled to a desired temperature. The air-cooled refrigerator-freezer needs corresponding air ducts for supplying air to each space.

A typical refrigerator provided with two or more doors comprises at least one freezing compartment and a plurality of refrigerating compartments. For some users with different needs, refrigerator compartments can achieve free switching among a freezing function, a soft freezing function and a refrigerating function. The air volume of the existing air-cooled refrigerator can be controlled only in two ways. The first way refers to mechanical control; that is, by adjusting the air outlet sectional area of an inner baffle of an air duct, the air volume is controlled, thereby adjusting various functions of the refrigerator. The other way refers to electronic control; that is, an electronic air door is operated to be opened or closed by receiving instructions from a panel to control the air volume, thereby adjusting the functions of the refrigerator. The first mechanical adjustment scheme in the prior art is only a rough air volume control scheme which is not integrated with electrical components such as a fan, a compressor and a control panel, resulting in low control efficiency, a relatively long control stroke (i.e., relatively slow temperature change) and imprecise temperature and function control. In the second control scheme, control instructions are input by a control panel, and the air door is controlled to be opened or closed only after a sensor senses the temperature. Therefore, the efficiency is low. When it is still impossible to cool quickly in a case where the air door is fully opened, the operating time of the compressor can be prolonged only, and therefore, the power consumption increases. In addition, the overall cost performance is relatively low, the overall structure is complex, and the maintenance is difficult.

SUMMARY OF THE INVENTION

An objective of the present invention is to provide an air volume adjustment device for a refrigerator. The air volume adjustment device is relatively low in cost and capable of realizing free switching of functions among a plurality of compartments for the refrigerator.

To fulfill said objective of the present invention, the present invention provides an air volume adjustment device for a refrigerator. The refrigerator comprises a cabinet body, a compressor and an evaporator, wherein: a first compartment and a second compartment are defined in the cabinet body; a first air inlet cavity communicated with the first compartment and a second air inlet cavity communicated with the second compartment are arranged on the back of the first compartment and the second compartment respectively; the compressor is arranged at the bottom of the cabinet body; the evaporator is arranged in an evaporator cavity of the cabinet body and is capable of supplying cold to the first compartment and the second compartment; the air volume adjustment device is arranged on the back of the first compartment and the second compartment and comprises a fan and a baffle; the baffle is arranged between the first air inlet cavity and the second air inlet cavity; the fan is capable of introducing cold air from the evaporator into the first air inlet cavity and the second air inlet cavity; the baffle is capable of moving among a plurality of positions to adjust the volume of air entering the first air inlet cavity and the second air inlet cavity; the refrigerator further comprises a controller connecting the compressor and the air volume adjustment device; the air volume adjustment device further comprises an operating knob and a potentiometer which are connected to the front side and the rear side of the baffle respectively; the operating knob is arranged inside one of the first compartment and the second compartment; the potentiometer is connected to the controller; the operating knob is capable of operably driving the baffle to move; the potentiometer transfers an electrical signal corresponding to a position of the baffle to the controller; the controller controls a rotational speed of the fan or controls the compressor to be started up or shut down.

As an improvement of an embodiment of the present invention, the operating knob is configured as a rotary knob which drives the baffle to rotate among the plurality of positions.

As an improvement of an embodiment of the present invention, the first compartment is configured as a refrigerating compartment the second compartment is configured as a freezing compartment the air volume adjustment device is arranged on the back of the freezing compartment.

As an improvement of an embodiment of the present invention, the cabinet body further comprises a front cover plate arranged on the back of the freezing compartment and a rear cover plate connected to the front cover plate; the first air inlet cavity and the second air inlet cavity are arranged between the front cover plate and the rear cover plate.

As an improvement of an embodiment of the present invention, the potentiometer is mounted on the rear cover plate.

As an improvement of an embodiment of the present invention, the operating knob is capable of driving the baffle to move among at least three positions, such that the refrigerator can be switched among at least three modes; in the first position, the volume of air entering the refrigerating compartment is approximately equal to that entering the freezing compartment, and the refrigerator is operating in a conventional mode; in the second position, the volume of air entering the refrigerating compartment is less than that entering the freezing compartment, and the refrigerator is operating in a fast cooling mode; in the third position, the volume of air entering the refrigerating compartment is greater than that entering the freezing compartment, and the refrigerator is operating in a freezing-to-refrigerating mode.

As an improvement of an embodiment of the present invention, in the fast cooling mode, the controller controls the rotational speed of the fan to increase by 10% compared to the conventional mode; in the freezing-to-refrigerating mode, the controller controls the rotational speed of the fan to reduce by 10% compared to the conventional mode.

As an improvement of an embodiment of the present invention, he air volume adjustment device further comprises a columnar body which passes through the front cover plate and the rear cover plate; the baffle is fixed on the columnar body; the operating knob and the potentiometer are connected to two ends of the columnar body, respectively.

As an improvement of an embodiment of the present invention, a rear plate of the freezing compartment is arranged in front of the front cover plate; a freezing air duct which is communicated with the freezing compartment is arranged between the front cover plate and the rear plate of the freezing compartment.

As an improvement of an embodiment of the present invention, a foam thermal-insulating layer is arranged between the front cover plate and the rear plate of the freezing compartment the freezing air duct is positioned between the front cover plate and the foam thermal-insulating layer.

Compared with the prior art, the present invention has the following beneficial effects: the refrigerator realizes free switching among the functions of a plurality of compartments of the refrigerator through an integrated structure including the mechanical rotary knob, the baffle and the potentiometer, thereby meeting the demands of a user on different functions of the compartments and meeting the maximum storage demand of the user on the refrigerator. The present invention creatively proposes the overall control scheme: when the rotary knob is rotated, a cold air distributor distributes the air volume proportionally as a mechanical structure. At the same time, the mechanical structure is connected to a computer board. With the angular rotation, an output signal of the computer board changes as a UI (user interface) input of the whole machine, and the compressor, the fan and the sensor cooperate at the same time. Therefore, the refrigerating efficiency is greatly improved, and the power consumption and the cost are reduced.

DETAILED DESCRIPTION OF THE EMBODIMENTS

Figure 1:
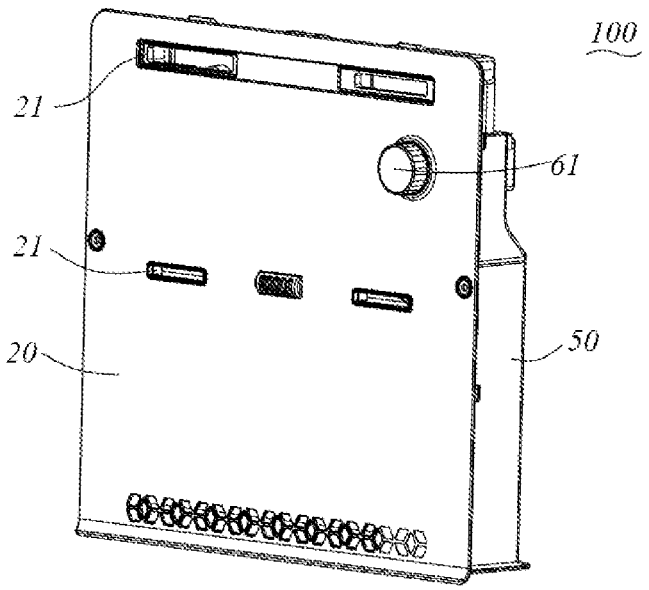
FIG. 1 is a perspective view of an air duct assembly of a refrigerator in a preferred embodiment of the present invention, in which the front of the air duct assembly is illustrated.
Figure 2:
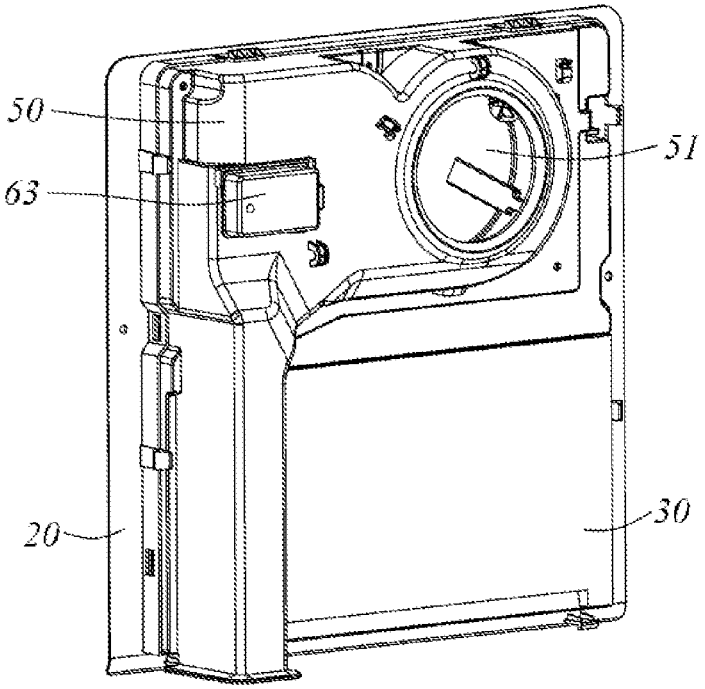
FIG. 2 is a perspective view of the air duct assembly in FIG. 1, in which the back of the air duct assembly is illustrated.
Figure 3:
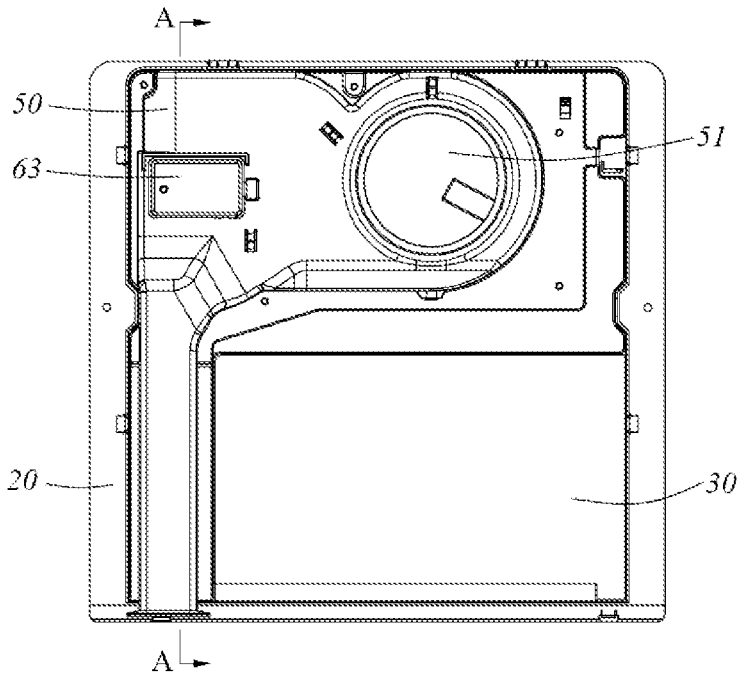
FIG. 3 is a front view of the air duct assembly in FIG. 2.
Figure 4:
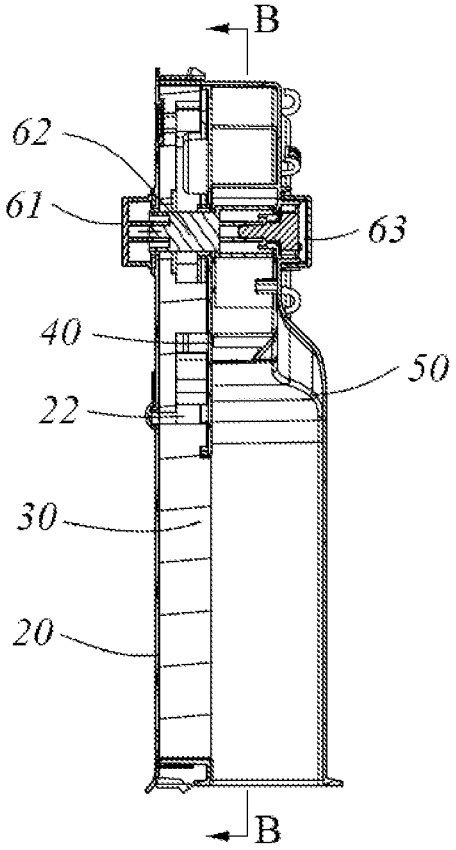
FIG. 4 is a sectional view along a line A-A in FIG. 3.

The present invention will be described in detail below with reference to the specific embodiments shown in the accompanying drawings. However, these embodiments are not intended to limit the present invention, and modifications in structures, methods, or functions made by those common skilled in the art according to these embodiments are all included in the protection scope of the present invention.

A refrigerator of a preferred embodiment of the present invention comprises a cabinet body 10 defining two cooling compartments, that is, a refrigerating compartment 101 and a freezing compartment 102, respectively. In general, the refrigerating compartment 101 and the freezing compartment 102 are arranged from top to bottom. Of course, three cooling compartments arranged from top to bottom or other configurations are also available. In the present embodiment, a direction in which the refrigerating compartment 101 and the freezing compartment 102 are arranged from top to bottom is defined as a height direction of the refrigerator. The directions in which a user opens the refrigerator facing a refrigerator door and opposing the refrigerator door are defined as front and back directions of the refrigerator. A direction perpendicular to the height direction and the thickness direction is defined as a width direction of the refrigerator.

The refrigerator is further provided with a compressor 103 and an evaporator 104. The compressor 103 is arranged at the bottom of the cabinet body 10. The evaporator 104 is arranged in an evaporator cavity at the upper part of the freezing compartment 102 of the cabinet body 10 and used for supplying cold to the freezing compartment 102 and the refrigerating compartment 101. A defroster is arranged at the lower part of the evaporator 104. The compressor 103 is arranged at the rear side of the bottom of the refrigerator. The evaporator 104 may be any known evaporator, such as one of a fin evaporator, a wire and tube evaporator, a blow-up evaporator, and a plate and tube evaporator. In the present embodiment, the refrigerator forms a compression and refrigeration cycle system through the compressor 103, a condenser and the evaporator 104.

As shown in FIGS. 1 to 6, in the present embodiment, the refrigerator further comprises an air duct assembly 100 which is arranged on the back of the refrigerating compartment 101 and the freezing compartment 102. The air duct assembly 100 comprises a rear plate 20 arranged on the back of the freezing compartment 102, and a front cover plate 40 and a rear cover plate 50 which are connected to the rear plate. A fan accommodating cavity 51 for accommodating a fan is formed between the front cover plate 40 and the rear cover plate 50. A first air inlet cavity 41 (i.e., a refrigerating air inlet cavity) communicated with the refrigerating compartment 101 and a second air inlet cavity 42 (i.e., a freezing air inlet cavity) communicated with the freezing compartment 102 are formed at an air outlet of the fan. A freezing air duct 22 is arranged between the front cover plate 40 and the rear plate 20 of the freezing compartment 102. The rear plate 20 of the freezing compartment 102 is further provided with an air vent 21. The front cover plate 40 is provided with a freezing air duct air-inlet 43 which is communicated with the freezing air duct 22. Cold air entering the second air inlet cavity 42 may enter the freezing air duct 22 through the freezing air duct air-inlet 43 and then enter the freezing compartment 102 through the air vent 21. A thermal-insulating layer 30 may also be arranged between the front cover plate 40 and the rear plate 20 of the freezing compartment 102 so as to reduce the cold loss and improve the insulation effect. A foam thermal-insulating layer is preferred as the thermal-insulating layer. A refrigerating air inlet duct 52 is arranged between the rear cover plate 50 and the thermal-insulating layer 30. Cold air entering the first air inlet cavity 41 may enter the refrigerating compartment 101 through the refrigerating air inlet duct 52.

The air duct assembly 100 comprises an air volume adjustment device. The air volume adjustment device comprises a fan and a baffle 64 arranged at one side of the fan. The fan is capable of introducing cold air from the evaporator 104 into the first air inlet cavity 41 and the second air inlet cavity 42. The baffle 64 is positioned between the first air inlet cavity 41 and the second air inlet cavity 42. The baffle 64 is capable of moving among a plurality of positions to adjust the volume of air entering the first air inlet cavity 41 and the second air inlet cavity 42, thereby controlling the volume of air entering the refrigerating compartment 101 and the freezing compartment 102.

Specifically, an operating knob 61 and a potentiometer 63 are connected to the front side and the rear side of the baffle 64, respectively. The operating knob 61 is arranged inside the freezing compartment 102. The potentiometer 63 is arranged on the rear cover plate 50. The operating knob 61 is capable of driving the baffle 64 to rotate. The baffle 64 rotates, such that the potentiometer 63 is capable of outputting a signal corresponding to a position of the baffle 64 to a controller of the refrigerator. The controller of the refrigerator controls a rotational speed of the fan or controls the compressor 103 to be started up or shut down. The air volume adjustment device further comprises a columnar body 62 which passes through the front cover plate 40 and the rear cover plate 50. The baffle 64 is fixed on the columnar body 62. The operating knob 61 and the potentiometer 63 are connected to two ends of the columnar body 62, respectively.

Preferably, the operating knob 61 is configured as a rotary knob which drives the baffle 64 to rotate among the plurality of positions. The rear plate 20 of the freezing compartment 102 may be printed with silk-screens with gear scales or marked with names of gears, or the rotary knob is printed with digits. These silk-screens may help the user understand the adjusted gears.

In the course of realizing free switching of the functions of a plurality of compartments, the volume of air entering the refrigerating compartment 101 and the freezing compartment 102 may be controlled by adjusting the position of the baffle 64. By using the characteristic of stepless adjustment of the resistance of the potentiometer 63 from small values to large ones, the rotary knob drives different gears of the baffle to output different signals to the controller. The controller learns the position of the gear set by the user so as to control the rotational speed of the fan or control the compressor 103 to be started up or shut down according to set control rules, such that the functions of the refrigerator meet the requirements of the user.

Figure 5:
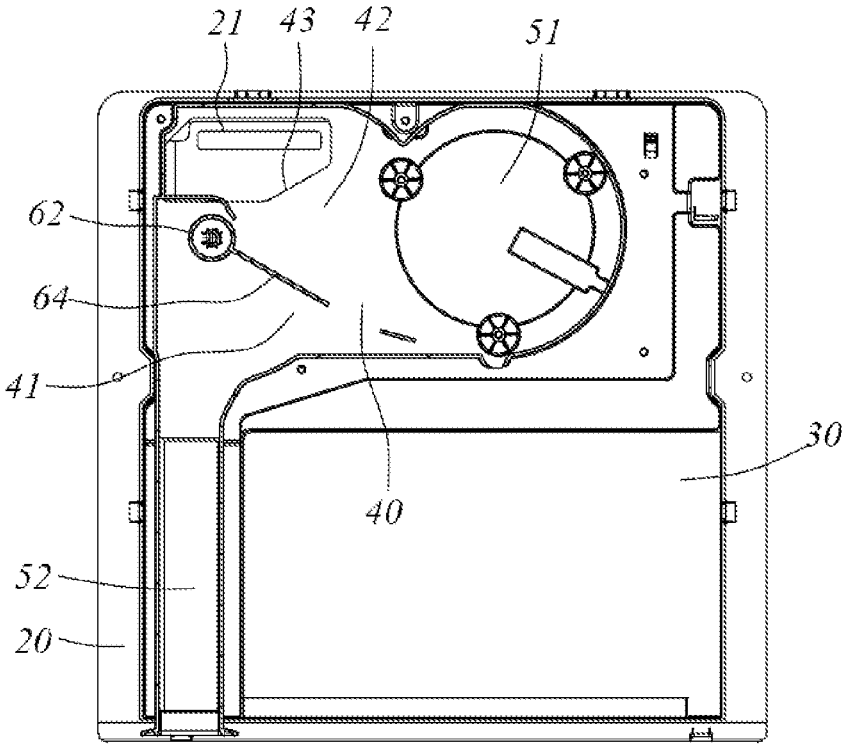
FIG. 5 is a sectional view along a line B-B in FIG. 4.
Figure 6:
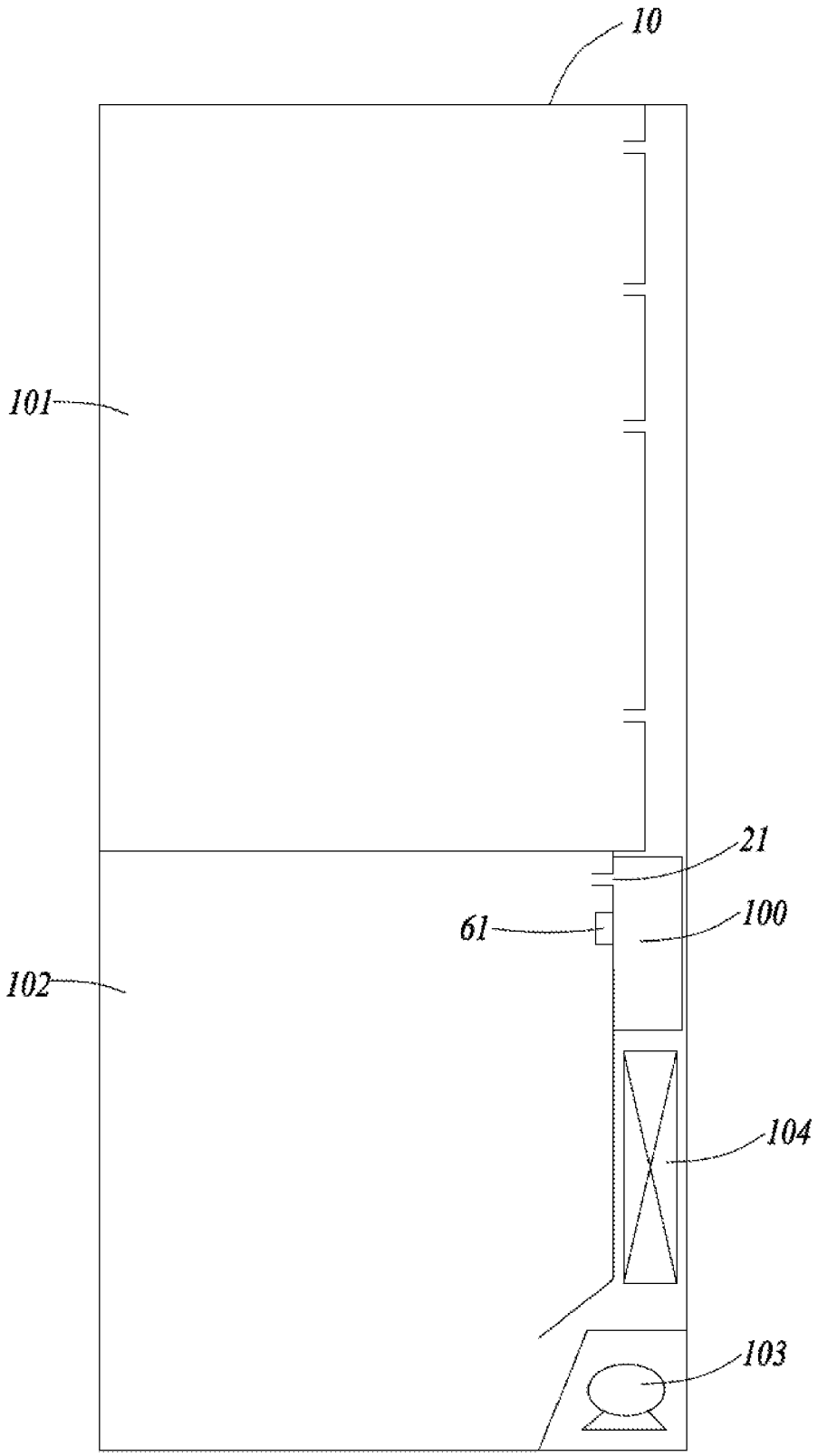
FIG. 6 is a schematic side view of a refrigerator having the air duct assembly in FIG. 1 in accordance with the present invention.

Specifically, the control logic is illustrated in FIG. 5. The method for controlling the operation of a refrigerator through a rotary knob comprises the following steps: S1, selecting a desired gear; S2, recognizing, by the controller, the selected gear through the potentiometer; S3, calling a control program of the selected gear, and determining startup and shutdown points of the selected gear; S4, judging whether the refrigerator meets the startup condition at present or not according to the startup and shutdown points of the selected gear, performing shutdown if the refrigerator does not meet the startup condition at present, or proceeding to the step S5 if the refrigerator meets the startup condition at present; S5, matching the startup and shutdown points of the selected gear and the rotational speed of the fan for operating according to the called control program; and S6, judging whether the shutdown point of the selected gear is reached or not, repeating the step S5 if the shutdown point of the selected gear is not reached, or performing shutdown if the shutdown point of the selected gears is reached.

In the present embodiment, there are four gears, i.e., a fast cooling gear, a conventional gear, an energy-saving gear and a freezing-to-refrigerating function gear at the rotary knob. The startup and shutdown points here refer to startup and shutdown conditions, which may be a time point, a number of opening and closing the refrigerator door, the temperature of the refrigerating compartment 101 or the freezing compartment 102 of the refrigerator, and the like.

For example, when the baffle 64 is set to have six positions a, b, c, d, e and f, the startup and shutdown points of the compressor 103, which are matched with the six positions, and the rotational speed of the fan are set as A, B, C, D, E and F respectively. When the user selects the gear of the baffle to be in the position a, the controller can analyze the corresponding startup and shutdown points according to the angle of the baffle 64 corresponding to the position a, thereby determining whether the compressor 103 needs to be started up. If the compressor 103 does not need to be started up, the compressor 103 is shut down. If the compressor 103 needs to be started up, the shutdown point and the rotational speed setting A of the fan are matched. That is, the start and shutdown of the compressor 103 and the rotational speed of the fan are controlled according to the program A, and then the compressor 103 is shut down if the requirement on the shutdown point in the program A is met.

A detailed description will be given below for the four gears, i.e., the fast cooling gear, the conventional gear, the energy-saving gear and the freezing-to-refrigerating function gear.

The fast cooling function refers to fast ice-making in the freezing compartment 102. A control method for the fast cooling function is as follows: when the rotary knob is adjusted to this gear, the connected baffle structure rotates, and an included angle between the baffle and the vertical direction towards the refrigerating air duct at this moment is 60 degrees. As shown in the figures, a part of air blown from the fan, which is represented by a solid line, directly enters the freezing air duct air-inlet 43. The other part of air blown from the fan, which is represented by a dotted line, is blocked by the baffle and then enters the freezing air duct. Because the normal control of refrigeration is still needed at this moment, a small part of gap is reserved. A ratio of the freezing air volume to the refrigerating air volume at this moment is 6:4. The functional requirement for freezing at this time is fast ice-making. When the rotary knob is adjusted to this gear, the rotational speed of the fan is also increased by 10%. At the same time, a freezing sensor is started to perform cross-comparison of data with a refrigerating sensor, thereby ensuring that the freezing compartment 102 can meet the gear requirement fast, and the temperature of the refrigerating compartment 101 is required not to be lower than 0° C. in the fast cooling process.

When the baffle is in the first position, the volume of air entering the refrigerating compartment 101 is approximately equal to that entering the freezing compartment 102, a ratio of the volume of air entering the refrigerating compartment 101 to the volume of air entering the freezing compartment 102 is 1:1 or so, and therefore, the conventional mode can be set. In the second position, the volume of air entering the refrigerating compartment 101 is less than that entering the freezing compartment 102, a ratio of the volume of air entering the refrigerating compartment 101 to the volume of air entering the freezing compartment 102 ranges from 2:8 to 4:6, and therefore the fast cooling mode can be set. In the third position, the volume of air entering the refrigerating compartment 101 is greater than that entering the freezing compartment 102, a ratio of the volume of air entering the refrigerating compartment 101 to the volume of air entering the freezing compartment 102 ranges from 6:4 to 8:2, and therefore the freezing-to-refrigerating mode can be set. Correspondingly, the rotational speed of the fan may be increased in the fast cooling mode; for example, the rotational speed of the fan is increased by about 10% compared to the conventional mode. The rotational speed of the fan may be reduced in the freezing-to-refrigerating mode; for example, the rotational speed of the fan is reduced by about 10% compared to the conventional mode.

It should be understood that although the description is described according to the above embodiments, each embodiment may not only include one independent technical solution. The presentation manner of the description is only for the sake of clarity. Those skilled in the art should take the description as an integral part. The technical solutions of the respective embodiments may be combined properly to form other embodiments understandable by those skilled in the art.

The above detailed description only illustrates the feasible embodiments of the present invention, and is not intended to limit the protection scope of the present invention. Equivalent embodiments or modifications within the scope and spirit of the present invention shall be embraced by the protection scope of the present invention.

What is claimed is:

1. A refrigerator comprising an air volume adjustment device, wherein the refrigerator comprises a cabinet body, a compressor and an evaporator, wherein:

a first compartment and a second compartment are defined in the cabinet body; a first air inlet cavity communicated with the first compartment and a second air inlet cavity communicated with the second compartment are arranged on a back of the first compartment and a back of the second compartment respectively;

the compressor is arranged at a bottom of the cabinet body;

the evaporator is arranged in an evaporator cavity of the cabinet body and is capable of supplying cold to the first compartment and the second compartment;

the air volume adjustment device is arranged on at least one of the backs of the first compartment and the second compartment, and comprises a fan and a baffle; the baffle is arranged between the first air inlet cavity and the second air inlet cavity; the fan is capable of introducing cold air from the evaporator into the first air inlet cavity and the second air inlet cavity; the baffle is capable of moving among a plurality of positions to adjust a volume of air entering the first air inlet cavity and a volume of air entering the second air inlet cavity; the refrigerator further comprises a controller connecting the compressor and the air volume adjustment device;

and wherein the air volume adjustment device further comprises an operating knob connected to a first side of the baffle and a potentiometer connected to a second side of the baffle opposite to the first side of the baffle along a direction perpendicular to a moving plane of the baffle; the operating knob is arranged inside one of the first compartment and the second compartment; the potentiometer is connected to the controller; the operating knob is capable of operably driving the baffle to move for selecting a desired gear of the baffle; the potentiometer transfers an electrical signal corresponding to a position of the baffle to the controller; the controller controls the fan according to the fan speed matched to the selected gear, and the controller controls the compressor to be started up or shut down according to a startup point or a shutdown point of the compressor matched to the selected gear.

2. The refrigerator according to claim 1, wherein the operating knob is configured as a rotary knob which drives the baffle to rotate among the plurality of positions.

3. The refrigerator according to claim 1, wherein the first compartment is configured as a refrigerating compartment; the second compartment is configured as a freezing compartment; the air volume adjustment device is arranged on the back of the freezing compartment.

4. The refrigerator according to claim 3, wherein the cabinet body further comprises a front cover plate arranged on the back of the freezing compartment and a rear cover plate connected to the front cover plate; the first air inlet cavity and the second air inlet cavity are arranged between the front cover plate and the rear cover plate.

5. The refrigerator according to claim 4, wherein the potentiometer is mounted on the rear cover plate.

6. The refrigerator according to claim 3, wherein the operating knob is capable of driving the baffle to move among at least three positions, such that the refrigerator can be switched among at least three modes; in the first position, the volume of air entering the refrigerating compartment is equal to that entering the freezing compartment, and the refrigerator is operating in a conventional mode; in the second position, the volume of air entering the refrigerating compartment is less than that entering the freezing compartment, and the refrigerator is operating in a fast cooling mode; in the third position, the volume of air entering the refrigerating compartment is greater than that entering the freezing compartment, and the refrigerator is operating in a freezing-to-refrigerating mode.

7. The refrigerator according to claim 6, wherein in the fast cooling mode, the controller controls the rotational speed of the fan to increase by 10% compared to the conventional mode; in the freezing-to-refrigerating mode, the controller controls the rotational speed of the fan to reduce by 10% compared to the conventional mode.

8. The refrigerator according to claim 4, wherein the air volume adjustment device further comprises a columnar body which passes through the front cover plate and the rear cover plate along the direction perpendicular to the moving plane of the baffle; the baffle is fixed on the columnar body to be movable on the moving plane; the operating knob and the potentiometer are connected to two ends of the columnar body, respectively.

9. The refrigerator according to claim 4, wherein a rear plate of the freezing compartment is arranged in front of the front cover plate; a freezing air duct which is communicated with the freezing compartment is arranged between the front cover plate and the rear plate of the freezing compartment.

10. The refrigerator according to claim 9, wherein a foam thermal-insulating layer is arranged between the front cover plate and the rear plate of the freezing compartment; the freezing air duct is positioned between the front cover plate and the foam thermal-insulating layer.

* * * * *